US007686192B1

(12) United States Patent
Patton et al.

(10) Patent No.: US 7,686,192 B1
(45) Date of Patent: Mar. 30, 2010

(54) DISPENSING DEVICE FOR VISCOUS PRODUCTS

(76) Inventors: Claire Jean Patton, 284 Blenheim Rd., Columbus, OH (US) 43214; Josephine Ann ElMaasarani, 276 W. Hull Dr., Delaware, OH (US) 43015; Juliana Nabeel ElMaasarani, 276 W. Hull Dr., Delaware, OH (US) 43015

( * ) Notice: Subject to any disclaimer, the term of this patent is extended or adjusted under 35 U.S.C. 154(b) by 387 days.

(21) Appl. No.: 11/764,616

(22) Filed: Jun. 18, 2007

(51) Int. Cl.
*A45D 40/02* (2006.01)
*A45D 40/04* (2006.01)

(52) U.S. Cl. ..... 222/390; 401/68; 401/174

(58) Field of Classification Search ..... 222/390; 401/68, 69, 70, 79, 172, 174
See application file for complete search history.

(56) References Cited

U.S. PATENT DOCUMENTS 33,637 A * 11/1861 Dungan et al. ..... 222/390
2,748,991 A * 6/1956 McCarthy ..... 222/390
4,595,124 A * 6/1986 Duval et al. ..... 222/390
5,062,551 A * 11/1991 Goldstein et al. ..... 222/390
5,228,818 A 7/1993 Laue
5,275,496 A 1/1994 Fattori
6,435,748 B1 8/2002 Taghikhani
2006/0088362 A1* 4/2006 Chase et al. ..... 401/172

* cited by examiner

*Primary Examiner*—Kenneth Bomberg
(74) *Attorney, Agent, or Firm*—Claire J. Patton

(57) ABSTRACT

One embodiment of a dispensing device for viscous products which includes a container, a screw-feed advancing assembly, and a hub assembly. Rotation of the screw-feed assembly causes the hub assembly to advance upwards and thereby advance the product upwards inside the container. The device maintains a separation of the screw-feed advancing assembly below from the product above and allows the user easier access to the product inside the container.

15 Claims, 9 Drawing Sheets

DISPENSING DEVICE FOR VISCOUS PRODUCTS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention generally relates to a dispensing device, and specifically to a dispensing device that can be used with viscous products.

2. Related Inventions

Previously, other types of dispensing devices have been designed to advance a product upwards in a container, but none have the advantages in design as stated in the present invention.

The present application applies where the value of the product is such that the user desires a large quantity of a viscous product in a vertical container. The larger, taller container is desired because viscous product inside a smaller, shallower container would be easily accessible to the user, but not as economical to buy. In a taller container, as the user manually removes the product, the level of the top of the product lowers inside. As the product level gets lower inside the container, the user tends to soil their hands and the handles of utensils they use while attempting to extract the product.

There are previous dispensing devices where a push top pump acts to dispense the product, but those designs are not practical where the product has a high viscosity, such as with peanut butter. A flexible squeeze tube design is also not practical for most users of large vertical containers of viscous product. An advancing plunger design would perform better in this application for moving a viscous product.

There are elongated plunger designs, such as those used for cookie presses, where the plunger stem and handle are external, below the product container. However, for those designs, the elongated stem of the plunger would take up a great deal of vertical shelf space. Also, when the container is full of product, the device would be top heavy. The high center of gravity in the container would make the device susceptible to tipping over. An elongated plunger would be awkward to use and to store in this type of application.

There are screw-feed assembly devices, such as those commonly used for dispensing solid sticks of deodorant or lipstick. Examples of these patents include U.S. Pat. No. 5,275,496 and 6,435,748. These devices are used with solid or gel products, and they have a central threaded member that rotates and thereby moves a plunger and the product upwards inside the container. However, the central threaded member rotates through and is in direct contact with the product.

There are viscous products such as peanut butter, where it is desired that the integrity and purity of the product be maintained. If the central threaded member was in direct contact with the product, it would provide an avenue for contamination to be communicated from the area below the plunger to the product chamber above. The object is to keep the product above the plunger separate from the feeding mechanism below. The design objective is to have a screw-feed assembly where the central threaded member does not penetrate the plunger, nor contact the product above, but such assembly would provide sufficient advancement elevation of the plunger inside the container.

SUMMARY

In accordance with one embodiment, the present design involves a dispensing device comprising a container, a screw-feed advancing assembly, a hub assembly, and a base plate. The container can be filled with a viscous product, and the user can rotate the screw-feed advancing assembly, causing the hub assembly to advance upwards and thereby advance the product upwards inside the container. The present design maintains a separation of the product above from the moving parts of the screw-feed advancing assembly below. The present design allows the user to keep the product level near the top of the container so the user does not soil their hands or utensils while attempting to access the product remaining in the bottom level of the container.

DRAWINGS

Figures

DRAWINGS

Reference Numerals

| | |
|---|---|
| 10 | container |
| 11 | container inner surface |
| 12 | container outer surface |
| 13 | container upper end |
| 14 | container lower end |
| 15 | product |
| 16 | support flange |
| 17 | support flange upper surface |

-continued

| | |
|---|---|
| 18 | knob handle access opening |
| 19 | removable closure |
| 20 | gasket |
| 21 | gasket outer edge |
| 22 | gasket lower surface |
| 23 | gasket upper surface |
| 30 | plunger assembly |
| 31 | plunger recess |
| 32 | plunger upper surface |
| 33 | plunger lower surface |
| 34 | plunger outer edge |
| 35 | plunger tabs |
| 40 | hub assembly |
| 41 | threaded coupling sleeve |
| 42 | sleeve inner surface |
| 43 | sleeve outer surface |
| 44 | long fin |
| 47 | short fin |
| 50 | base plate |
| 52 | retainer tabs |
| 53 | base plate opening |
| 60 | screw-feed advancing assembly |
| 61 | knob handle |
| 62 | thickened region |
| 63 | lip |
| 70 | lower threaded member |
| 71 | lower threaded member lower end |
| 72 | lower threaded member upper end |
| 80 | upper threaded member |
| 81 | upper threaded member lower end |
| 82 | upper threaded member upper end |
| 83 | vertical segments |
| 84 | lower threaded portion |
| 85 | upper non-threaded portion |
| 90 | central rod |
| 91 | elongated member |
| 92 | central rod retaining plate |
| 93 | central rod head |
| 100 | alternate fin |
| 110 | alternate screw-feed advancing assembly |
| 120 | alternate upper threaded member |
| 121 | alternate lower end |
| 122 | alternate upper end |
| 123 | alternate vertical segments |
| 130 | alternate central rod |
| 135 | rod top plate |
| 140 | segment hinge |
| 150 | spacer ring |
| 155 | spacer tabs |

DETAILED DESCRIPTION

First Embodiment—FIGS. 1-6 and FIG. 10

Figure 1:
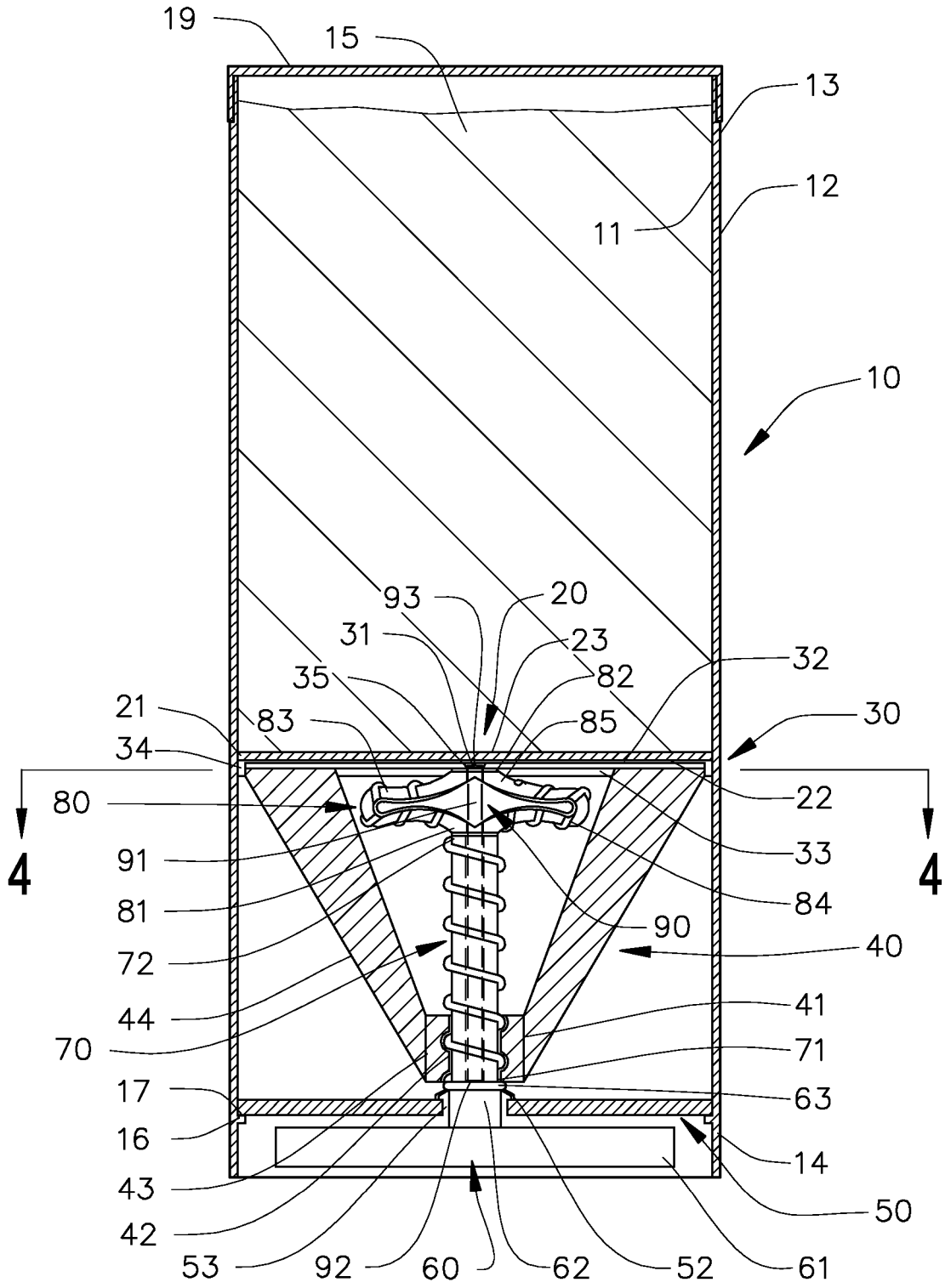
FIG. 1 is a vertical cross-sectional view along the long side of a device incorporating the design features of a first embodiment of the present invention with the vertical segments of the upper threaded member in the open position.
Figure 2:
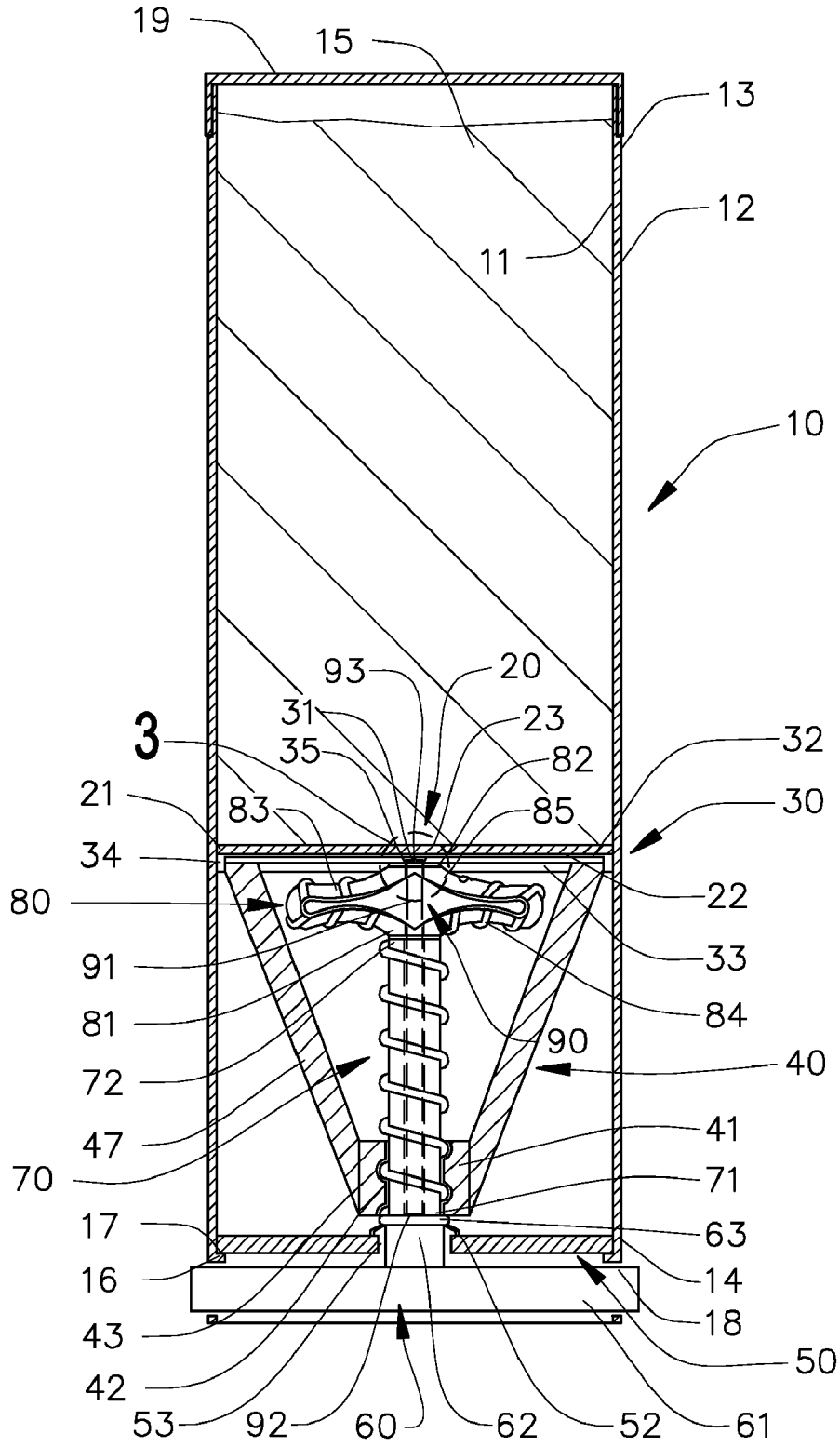
FIG. 2 is a vertical cross-sectional view along the short side, similar to FIG. 1, with the vertical segments of the upper threaded member in the open position.
Figure 3:
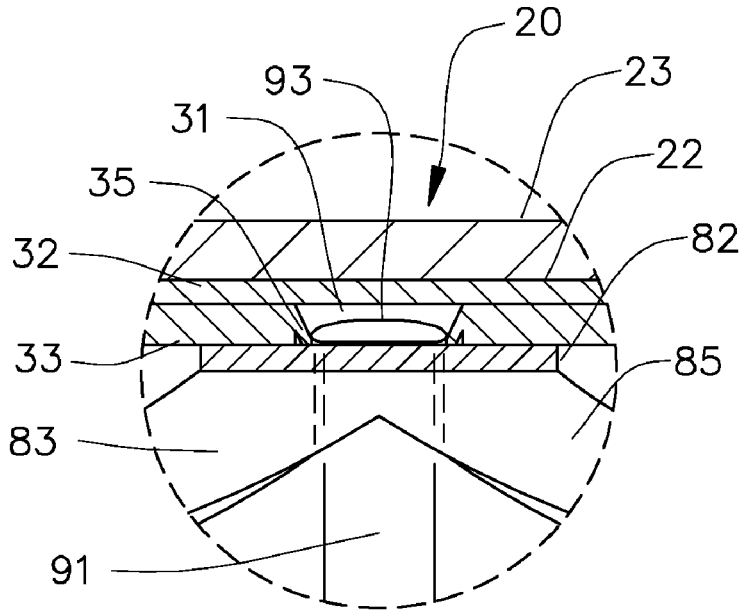
FIG. 3 is an enlarged view of the plunger recess of FIG. 2.
Figure 4:
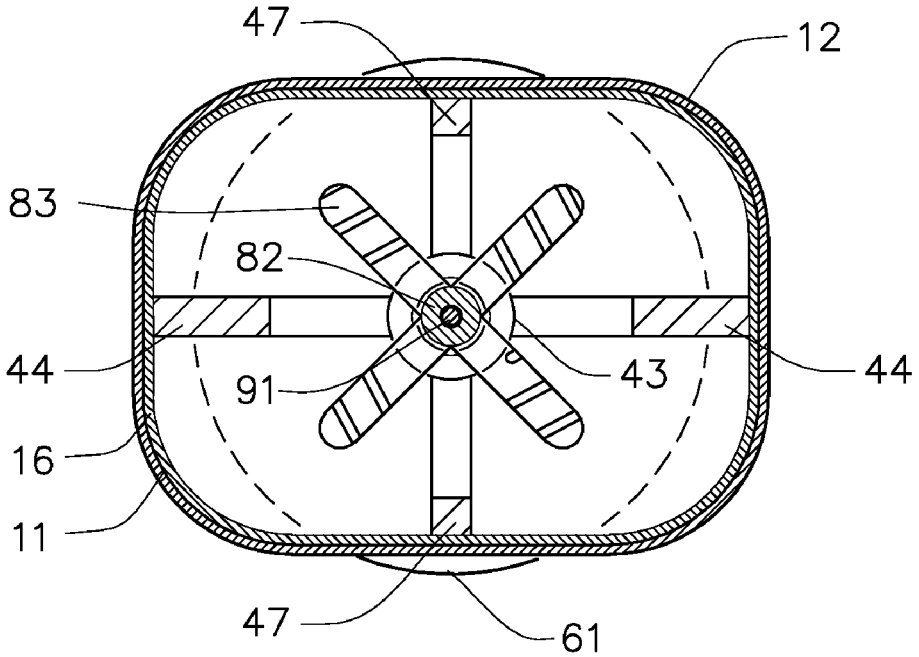
FIG. 4 is a horizontal cross-sectional view taken along line 4-4 of FIG. 1.
Figure 5:
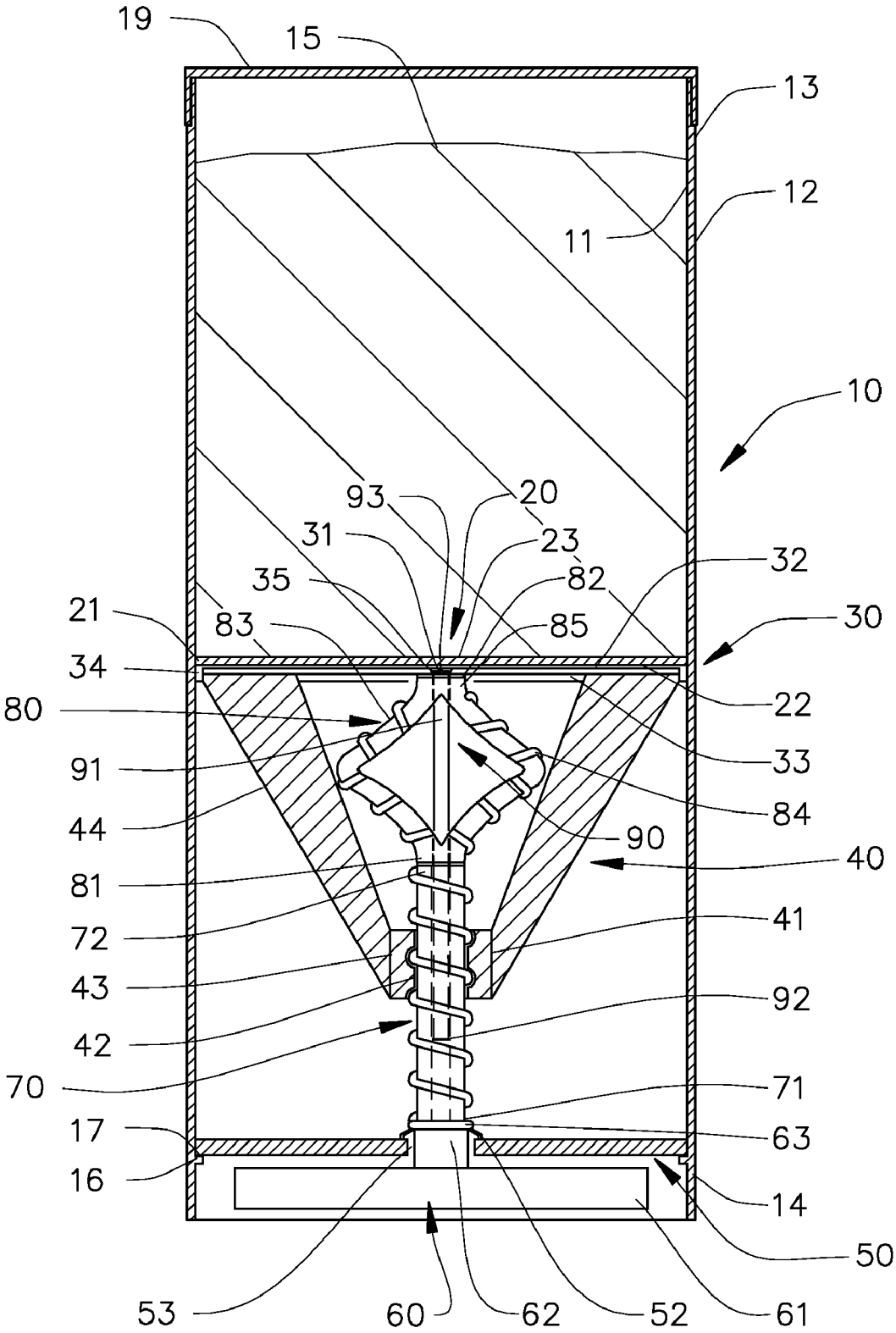
FIG. 5 is a vertical cross-sectional view similar to FIG. 1, with the vertical segments of the upper threaded member in the intermediate position.
Figure 6:
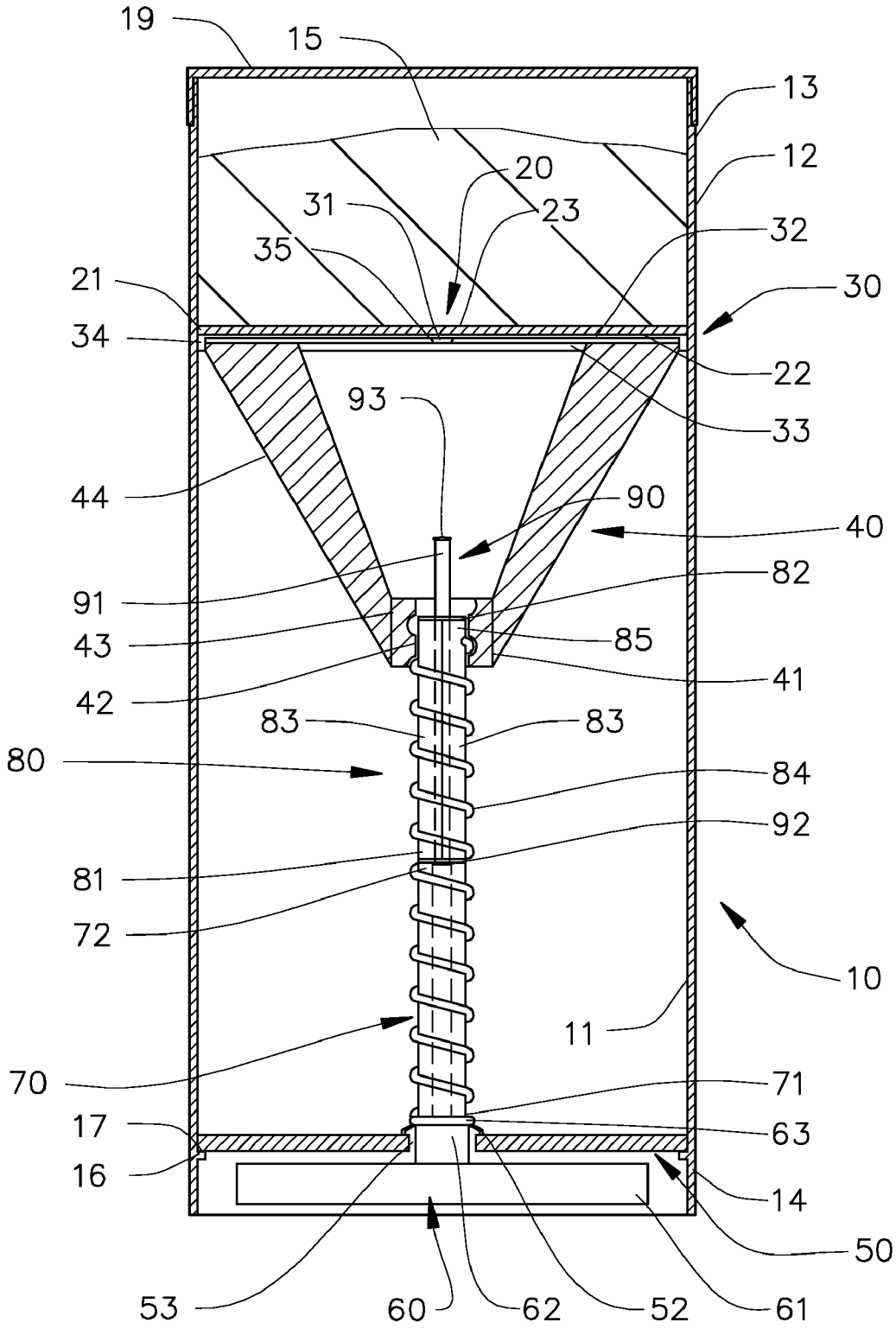
FIG. 6 is a vertical cross-sectional view similar to FIG. 1, with the vertical segments of the upper threaded member in the closed position.

As shown in FIG. 1, a first embodiment of the present invention comprises container 10, screw-feed advancing assembly 60, hub assembly 40, and base plate 50.

Container 10 is preferably open ended and preferably tubular in shape, and the cross section is preferably rectangular shaped, with preferably rounded corners. Container 10 has upper end 13, lower end 14, inner surface 11 and outer surface 12.

Upper end 13 has removable closure 19. Lower end 14 has support flange 16 and a plurality of knob handle access openings 18 (refer to FIG. 2 vertical section and FIG. 10 elevation).

Support flange 16 is preferably formed along the circumference of container inner surface 11. Support flange 16 is made a predetermined thickness and width as required to provide support for base plate 50.

Knob handle access openings 18 (refer to FIG. 2 section and FIG. 10 elevation) are located at the bottom of container lower end 14. Access openings 18 are preferably cut-outs of predetermined width and height as required to allow the user access to turn knob handle 61.

Container 10 is preferably made of plastic, but could be made of other materials such as metal or rubber, as long as the strength and rigidity of the members are not compromised.

Container 10 is made a predetermined height, width, and depth as required to accommodate a predetermined quantity of product 15. The cross section of container 10 and other corresponding members can also have other shapes such as oval or circular.

Screw-feed advancing assembly 60 comprises knob handle 61, thickened region 62, lip 63, lower threaded member 70, upper threaded member 80, and central rod 90.

Thickened region 62 is formed centrally on the upper surface of knob handle 61. Lip 63 is formed centrally on the upper surface of thickened region 62. Lower threaded member 70 has a lower end 71 and an upper end 72. Lower threaded member 70 is formed centrally with lower end 71 positioned centrally on the upper surface of lip 63. Lower threaded member 70 is preferably hollow and has a substantially helical camming surface, which is male threaded.

Upper threaded member 80 has a lower end 81, an upper end 82, a plurality of vertical segments 83, a lower threaded portion 84, and an upper non-threaded portion 85. Upper threaded member lower end 81 is securedly attached axially to lower threaded member upper end 72. This can be accomplished preferably by use of adhesives, but can also be by other means provided the strength and rigidity of the screw-feed advancing assembly 60 are not compromised.

Upper threaded member 80 is preferably hollow and lower threaded portion 84 has a substantially helical camming surface, which is male threaded.

Upper threaded member 80 is preferably equally divided axially into a plurality of vertical segments 83. Vertical segments 83 are capable of deflection and have a closed, vertical position, translate into an intermediate, partially compressed position, and have a fully opened, compressed position.

Upper threaded member 80 is preferably constructed of a flexible material which enables axial compression of vertical segments 83 into a fully opened, compressed position, corresponding to container 10 being fully loaded with product 15.

Vertical segments 83 are capable of regaining substantial vertical elevation in transition to the closed, vertical position, as product 15 is removed from container 10. Thus, the design of upper threaded member 80 provides the unexpected result of functioning as both a spring advancing means and as a screw-feed advancing means.

Lower threaded member 70 and upper threaded member 80 are preferably in substantially no contact with product 15.

Central rod 90 comprises elongated member 91, central rod retaining plate 92, and central rod head 93.

Elongated member 91 is capable of sliding, axial movement within lower threaded member 70 and upper threaded member 80. Central rod retaining plate 91 is capable of fitting within lower threaded member 70, while preferably being incapable of fitting within upper threaded member 80, such that plate 91 preferably acts as a lower retaining means for central rod 90.

Central rod head 92 is preferably incapable of fitting within upper threaded member 80, such that rod head 92 preferably acts as an upper retaining means for central rod 90.

Knob handle 61, thickened region 62, lip 63, lower threaded member 70, and central rod 90 are preferably made of plastic, but could be made of other materials such as metal or rubber, as long as the strength and rigidity of the members are not compromised.

Screw-feed advancing assembly 60 is made a predetermined height to maintain a predetermined ratio of height of container 10 over height of assembly 60.

Hub assembly 40 comprises threaded coupling sleeve 41, a plurality of long fins 44, a plurality of short fins 47, plunger 30, and gasket 20.

Threaded coupling sleeve 41 has sleeve inner surface 42, sleeve outer surface 43, and is preferably hollow.

Plunger 30 is planar and positioned perpendicular to container inner surface 11. It is preferably rectangular shaped with preferably rounded corners and made to fit within container 10. Plunger 30 is made a predetermined depth as required for support and advancement of product 15 above. Plunger 30 has upper surface 32, lower surface 33, and outer edge 34.

Sleeve inner surface 42 has a substantially helical camming surface which is female threaded and is capable of engaging lower threaded member 70 and upper threaded member 80. Sleeve inner surface 42 is capable of engaging upper threaded member 80 when upper threaded member 80 is in its closed, vertical position.

Long fins 44 are planar and positioned parallel and opposite to each other. They are formed preferably at an angle from sleeve outer surface 43 to plunger outer edge 34 and plunger lower surface 33.

Short fins 47 are planar and positioned parallel and opposite to each other. They are formed preferably at an angle from sleeve outer surface 43 to plunger outer edge 34 and plunger lower surface 33. Short fins 47 are each preferably located perpendicular to and in between each long fin 44.

Plunger lower surface 33 has centrally located plunger recess 31. Recess 31 has a plurality of centrally located plunger tabs 35. Plunger tabs 35 are capable of releasable engagement with central rod head 92. Central rod head 92 is preferably capable of a friction fit inside plunger tabs 35. Plunger tabs 35 are formed of a predetermined shape and size to provide support for central rod head 92.

Threaded coupling sleeve 41, long fins 44, short fins 47, and plunger 30 are preferably made of plastic, but could be made of other materials such as metal or rubber, as long as the strength and rigidity of the members are not compromised.

Gasket 20 is planar and capable of releasable attachment to plunger upper surface 32. Gasket 20 is preferably rectangular shaped with preferably rounded corners and is made to fit within container 10. Gasket 20 is capable of maintaining a seal along its perimeter between container inner surface 11 and product 15.

Gasket 20 is preferably made of silicone, but could be made of other materials such as rubber or other plastics, as long as the strength, rigidity and sealing ability of the member are not compromised.

Base plate 50 has central base plate opening 53 and a plurality of retainer tabs 52. Base plate 50 is planar and positioned perpendicular to container inner surface 11. Base plate 50 is preferably rectangular shaped with preferably rounded corners and is made to fit within container 10. It is made a predetermined depth as required to provide support for screw-feed advancing assembly 60.

Retainer tabs 52 are centrally located around the perimeter of central base plate opening 53. Central base plate opening 53 is sized to accommodate the insertion of upper threaded member 80, lower threaded member 70, lip 63, and thickened region 62 of screw-feed advancing assembly 60.

Retainer tabs 52 are preferably capable of deflection such that lip 63 can pass upward through tabs 52 and be retained substantially in position. Retainer tabs 52 are formed of a predetermined shape and size to provide support for lip 63.

Base plate 50 is preferably capable of releasable attachment to support flange upper surface 17 in container lower end 14. Base plate 50 can also be made an integrally formed part of container 10. Base plate 50 is preferably made of plastic, but could be made of other materials such as metal or rubber, as long as the strength and rigidity of the members are not compromised.

OPERATION

First Embodiment—FIGS. 1-6 and FIG. 10

The dispensing device is constructed by base plate 50 being inserted through container upper end 13 and set down on top of support flange upper surface 17. Thereafter, screw-feed advancing assembly 60 can be inserted through container lower end 14. Upper threaded member 80 with central rod 90 positioned within can then be inserted up from below into base plate opening 53, with lip 63 pushing up past retainer tabs 52, after which retainer tabs 52 resume their normal position and retain said lip 63 in position above.

Thereafter, hub assembly 40 can be inserted through container upper end 13, then moved down towards container lower end 14 and positioned on top of screw feed advancing assembly 60 upper threaded member 80.

Thereafter, knob handle 61 can be rotated and upper threaded member 80 shall be rotatable relative to hub coupling sleeve 41, such that relative rotation between the members will cause an axial displacement therebetween and a corresponding downward movement of coupling sleeve 41 and plunger 30.

Thereafter, coupling sleeve 41 can engage lower threaded member 70, and plunger lower surface 33 can exert a downward force on upper threaded member upper end 82. Downward movement of plunger 30 then acts to compress vertical segments 83 of upper threaded member 80.

Thereafter, coupling sleeve 41 shall continue to move downward axially onto lower threaded member 70 until setting on top of lip 63. As upper threaded member 80 reaches its fully open, compressed position, central rod head 92 shall push up through plunger tabs 35, and rod head 92 shall be retained.

Thereafter, product 15 shall be introduced into container 10, filling until reaching a predetermined level, after which removable closure 19 can be secured to container upper end 13.

The user can thereafter remove closure 19 to access product 15, and elect to rotate knob handle 61 in order to advance coupling sleeve 41 upwards axially along lower threaded member 70, thereby advancing plunger 30 and product 15 upwards inside container 10.

Thereafter, vertical segments 83 of upper threaded member 80 are decompressed, resuming the closed position, and are available for helical engagement. Coupling sleeve 41 can then advance upwards along upper threaded member 80, until reaching upper threaded member upper non-threaded portion 85, which preferably acts as a limit stop when plunger 30 reaches a predetermined limit elevation.

DETAILED DESCRIPTION AND OPERATION

Figure 7:
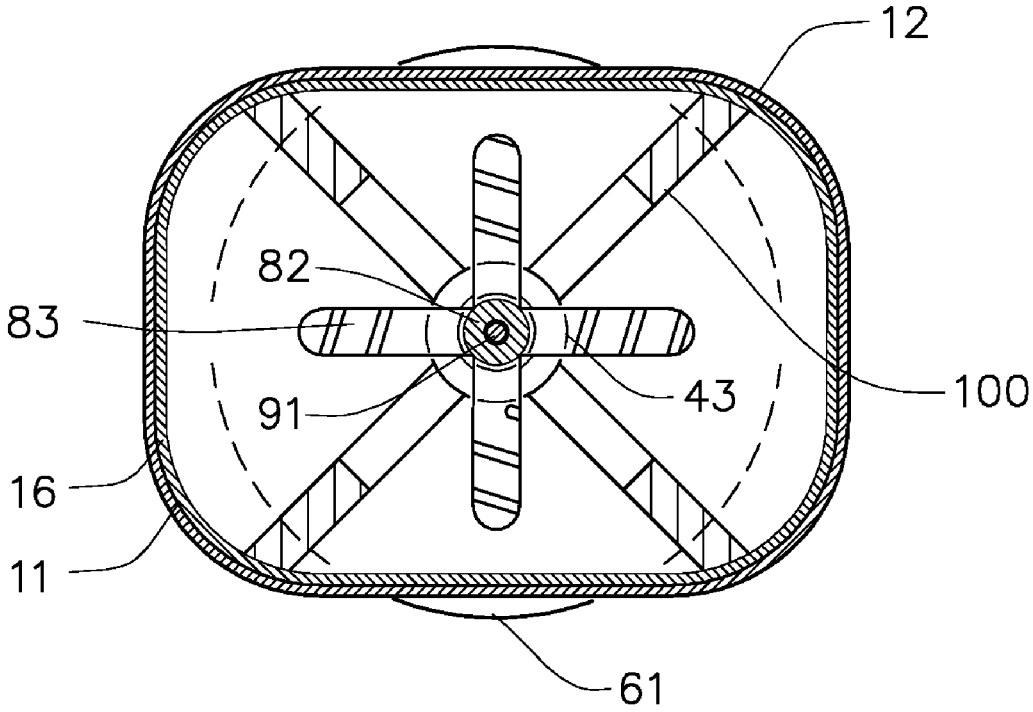
FIG. 7 is a horizontal cross-sectional view similar to FIG. 4, showing an alternate embodiment for the fins.

Second Embodiment—FIG. 7

As shown in FIG. 7, an alternate embodiment of the present invention uses a hub assembly 40 with a plurality of alternate fins 100, in lieu of a plurality of long fins 44 and short fins 47.

The alternate fins 100 would be of equal length, and each preferably positioned to align with the four corners of container 10.

DETAILED DESCRIPTION

Figure 8:
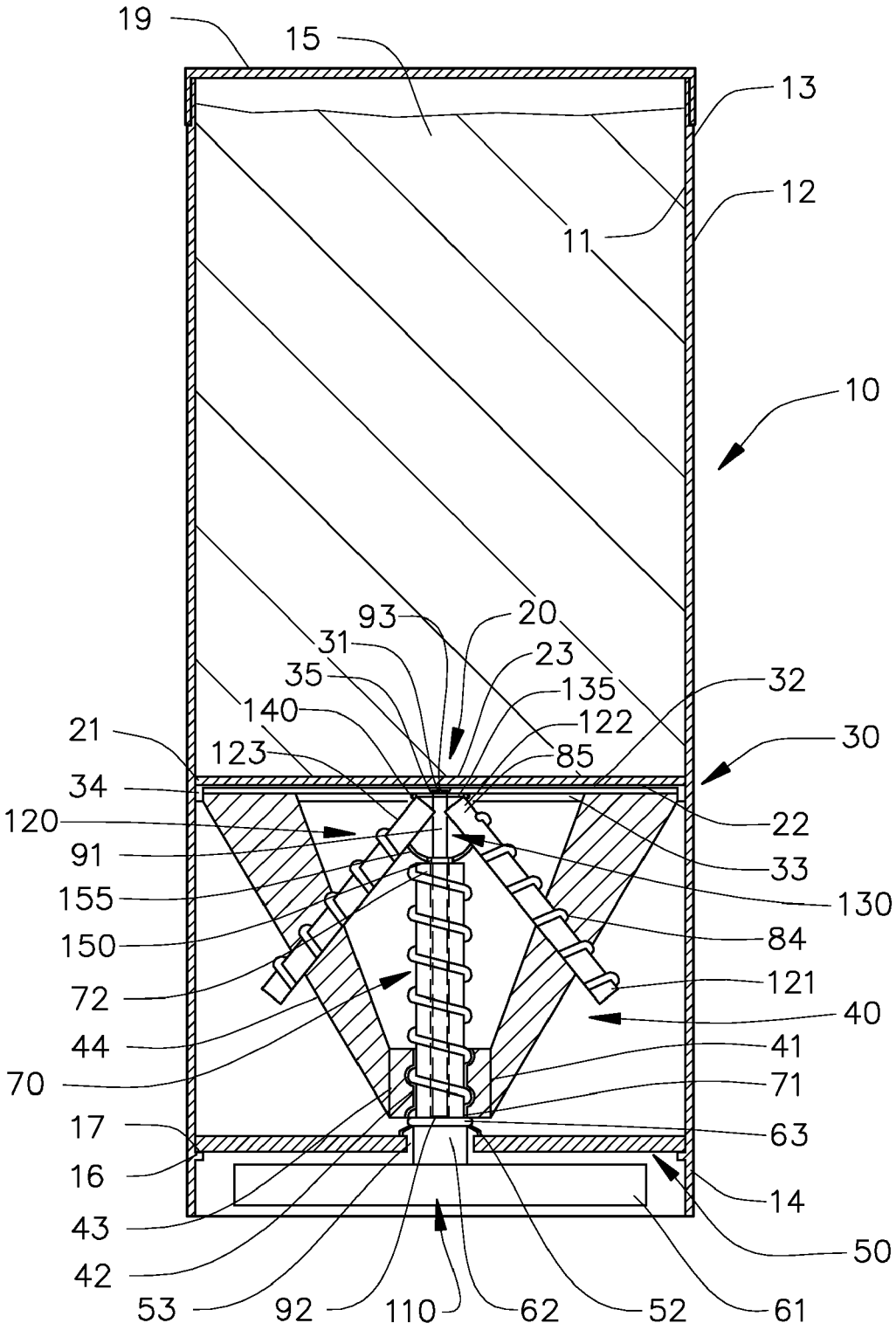
FIG. 8 is a vertical cross-sectional view similar to FIG. 1, showing an alternate embodiment using a hinged upper threaded member in the open position.
Figure 9:
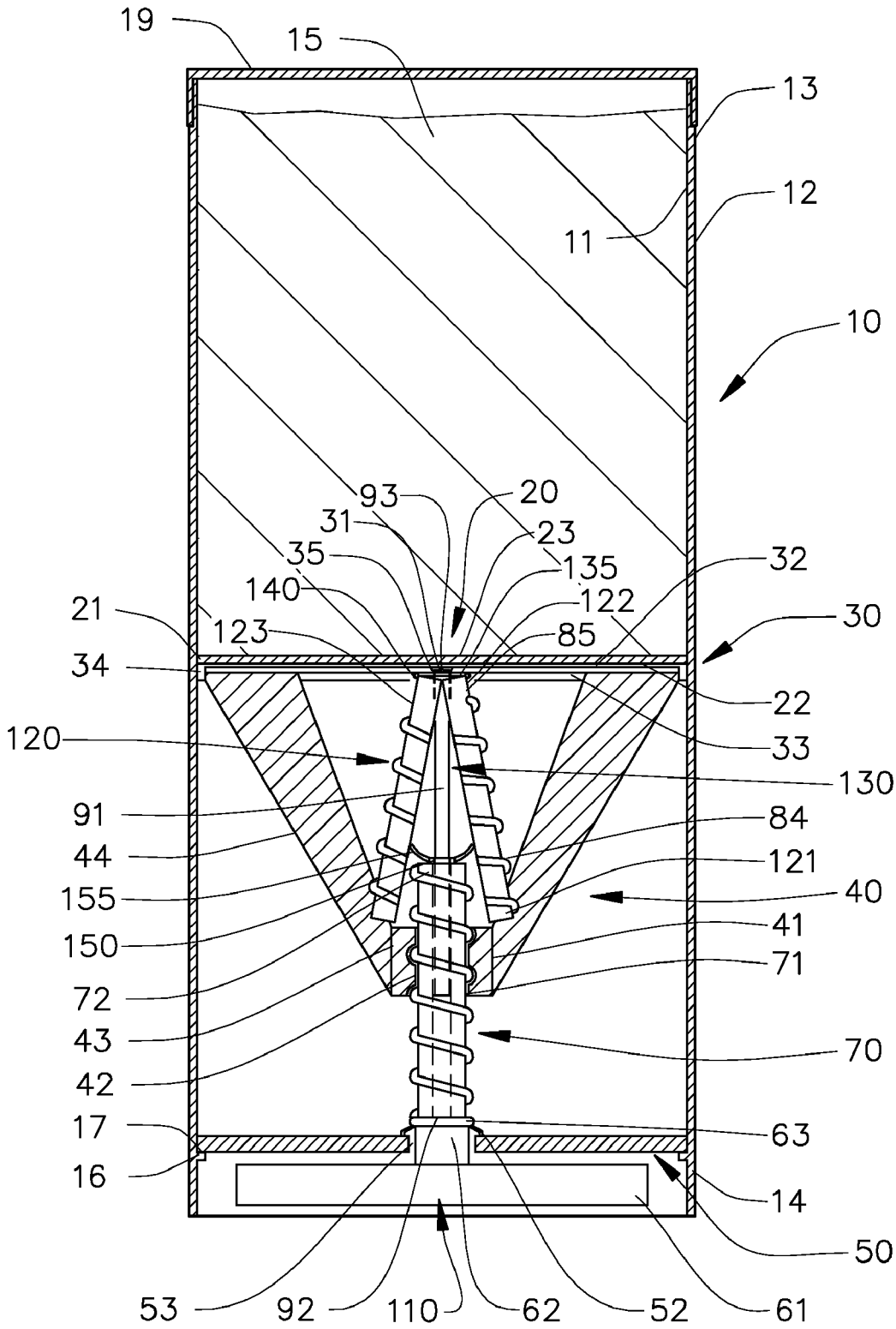
FIG. 9 is a cross-sectional view similar to FIG. 8, with the hinged upper threaded members in the intermediate position.
Figure 10:
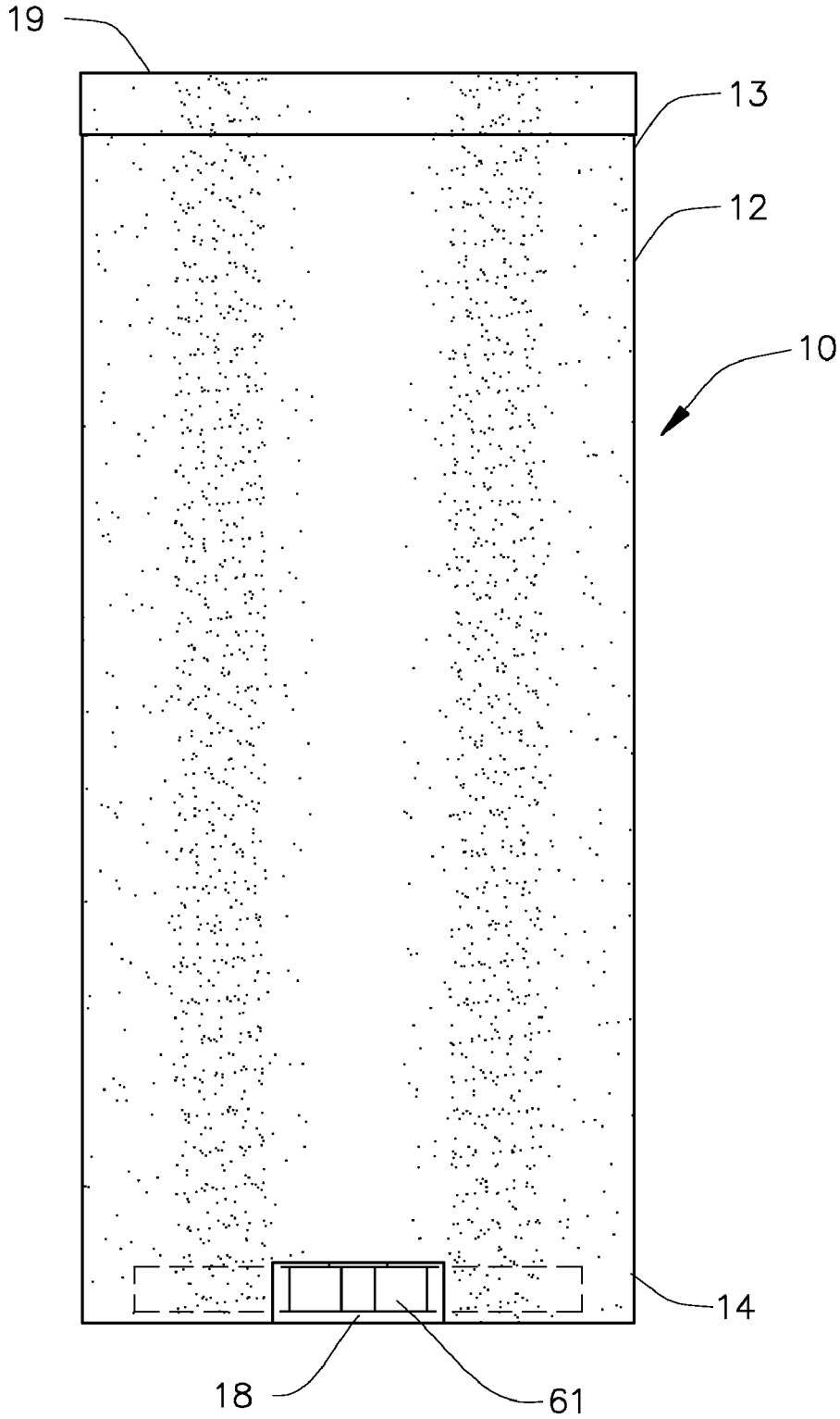
FIG. 10 is an elevation view of the long side of the device shown in FIG. 1 and in FIG. 8.

Third Embodiment—FIGS. 8-10

As shown in FIG. 8, an alternate embodiment of the present invention comprises container 10, alternate screw-feed advancing assembly 110, hub assembly 40, and base plate 50. Container 10, hub assembly 40, and base plate 50 are as shown and described in FIGS. 1-6 above.

Alternate screw-feed advancing assembly 110 comprises knob handle 61, thickened region 62, lip 63, lower threaded member 70, alternate upper threaded member 120, and alternate central rod 130.

Knob handle 61, thickened region 62, lip 63, and lower threaded member 70 are as shown and described in FIGS. 1-6 above.

Alternate upper threaded member 120 has an alternate lower end 121, an alternate upper end 122, a plurality of alternate vertical segments 123, a lower threaded portion 84, and an upper non-threaded portion 85.

Alternate central rod 130 comprises elongated member 91, central rod retaining plate 92, spacer ring 150, rod top plate 135 and central rod head 93. Rod top plate 135 is planar, preferably circular, and formed just below central rod head 93.

Alternate vertical segments 123 are each securedly attached at their upper end to rod top plate 135 by segment hinge 140. This can be accomplished preferably by use of adhesives, but can also be by other means provided the strength and rigidity of the screw-feed advancing assembly 60 are not compromised.

Alternate upper threaded member 120 is preferably hollow and lower threaded portion 84 has a substantially helical camming surface, which is male threaded.

Alternate upper threaded member 120 is preferably totally equally divided axially into a plurality of alternate vertical segments 123. Alternate vertical segments 123 are preferably rigid material, and have a closed, vertical position, translate into an intermediate, partially open position, and have a fully opened position.

Alternate upper threaded member 120 is preferably hinged into a fully opened position when container 10 is fully loaded with product 15.

Alternate vertical segments 123 are capable of regaining substantial vertical elevation in transition to the closed, vertical position, as product 15 is removed from container 10. As alternate vertical segments 123 reach the closed position, upper threaded member 120 alternate lower end 121 aligns and meets with lower threaded member upper end 72.

Alternate upper threaded member 120 is preferably in substantially no contact with product 15.

Spacer ring 150 is planar and has a plurality of spacer tabs 155. Spacer ring 150 is preferably circular and made to fit loosely around central rod elongated member 91. Ring 150 can preferably set in a stationary position on top of lower threaded member upper end 72.

Spacer tabs 155 are located along the periphery of spacer ring 150, are preferably flexible, and are made a predetermined size to maintain a clearance distance between alternate vertical segments 123 and lower threaded member upper end 72.

Alternate members from the second embodiment are preferably made of plastic, but could be made of other materials such as metal or rubber, as long as the strength and rigidity of the members are not compromised.

OPERATION

Third Embodiment—FIGS. 8-9 and FIG. 10

The dispensing device is constructed by base plate 50 being inserted through container upper end 13 and set down on top of support flange upper surface 17. Thereafter, alternate screw-feed advancing assembly 110 can be inserted through container lower end 14. Alternate upper threaded member 120 with alternate central rod 130 positioned within can then be inserted up from below into base plate opening 53, with lip 63 pushing up past retainer tabs 52, after which retainer tabs 52 resume their normal position and retain lip 63 in position above.

Thereafter, hub assembly 40 can be inserted through container upper end 13, then moved down towards container lower end 14 and positioned on top of alternate screw feed advancing assembly 110 upper threaded member 120.

Thereafter, knob handle 61 can be rotated and alternate upper threaded member 120 shall be rotatable relative to hub coupling sleeve 41, such that relative rotation between the members will cause an axial displacement therebetween and a corresponding downward movement of coupling sleeve 41 and plunger 30.

Thereafter, coupling sleeve 41 engages lower threaded member 70, and alternate vertical segments 123 of upper threaded member 120 are free to separate out from alternate central rod 130 via segment hinges 140. Spacer tabs 155, which were compressed while alternate vertical segments 123 were in their closed position, are then released to maintain clearance between segments 123 and lower threaded member upper end 72.

Thereafter, coupling sleeve 41 shall continue to move downward axially onto lower threaded member 70 until setting on top of lip 63. As alternate upper threaded member 120 reaches its fully open position, central rod head 92 shall push up through plunger tabs 35, and rod head 92 shall be retained.

Thereafter, product 15 shall be introduced into container 10, filling until reaching a predetermined level, after which removable closure 19 can be secured to container upper end 13.

The user can thereafter remove closure 19 to access product 15, and elect to rotate knob handle 61 in order to advance coupling sleeve 41 upwards axially along lower threaded member 70, thereby advancing plunger 30 and product 15 upwards inside container 10.

Thereafter, as plunger 30 and alternate upper threaded member 120 advance upwards, alternate vertical segments 123 fold inward, compressing spacer tabs 155, and resume the closed position, and are available for helical engagement. Coupling sleeve 41 can then advance upwards along alternate upper threaded member 120, until reaching upper threaded member upper non-threaded portion 85, which preferably acts as a limit stop when plunger 30 reaches a predetermined limit elevation.

SCOPE

There can be various alternate embodiments of the dispensing device that employ alternate upper threaded members to achieve the design objective. The upper threaded member can be jointed or hinged at some point along the vertical segments, and designed to fold when the container is full, and to unfold for helical engagement. Also, the lower and upper threaded members could be a one piece single element. The single threaded member could have an upper portion that functions as the upper threaded member described previously. Also, the single threaded member could be of a telescoping design where all layers are nested when the container is full, and each layer successively deploys vertically as product is removed from the container.

Thus, the scope of the invention should be determined by the appended claims and their legal equivalents, and not by the examples given.

What is claimed is:

1. A dispensing device comprising:

a) a container, said container having an upper end and a lower end, said container having an inner surface and an outer surface, said upper end having a removable closure, said lower end having a support flange and a plurality of knob handle access openings, said support flange being formed along a circumference of said inner surface, said knob handle access openings being located at a bottom of said lower end;

b) a screw-feed advancing assembly, said screw-feed advancing assembly comprising a knob handle, a thickened region, a lip, a lower threaded member, an upper threaded member, and a central rod, said thickened region being formed centrally on an upper surface of said knob handle, said lip being formed centrally on an upper surface of said thickened region, said lower threaded member having a lower end and an upper end, said lower threaded member being formed centrally with said lower end positioned on an upper surface of said lip, said lower threaded member being hollow and having a substantially helical camming surface, said upper threaded member including a lower end, an upper end, a lower threaded portion, and an upper non-threaded portion, said upper threaded member lower end being securedly attached axially to said lower threaded member upper end, said upper threaded member being hollow, and said lower threaded portion having a substantially helical camming surface, said lower threaded member and said upper threaded member being in substantially no contact with a product, said central rod comprising an elongated member, a central rod retaining plate, and a central rod head, said elongated member being capable of sliding, axial movement within said lower threaded member and said upper threaded member;

c) a hub assembly, said hub assembly comprising a threaded coupling sleeve, a plurality of long fins, a plurality of short fins, a plunger, and a gasket, said threaded coupling sleeve having a sleeve inner surface, a sleeve outer surface, and being hollow, said plunger being planar and positioned perpendicular to said container inner surface, said plunger having an upper surface, a lower surface, and an outer edge, said threaded coupling sleeve inner surface having a substantially helical camming surface which is female threaded and being capable of engaging said lower threaded member and said upper threaded member, said long fins being planar and positioned parallel and opposite to each other, being formed at an angle from said sleeve outer surface to said plunger outer edge and said plunger lower surface, said short fins being planar and positioned parallel and opposite to each other, being formed at an angle from said sleeve outer surface to said plunger outer edge and said plunger lower surface, said plunger lower surface having a centrally located recess area, said recess area having a plurality of centrally located plunger tabs, said plunger tabs being capable of releasable engagement with said central rod head, said central rod head being capable of a friction fit inside said plunger tabs, said gasket being planar and capable of releasable attachment to said plunger upper surface, said gasket being capable of maintaining a seal along its perimeter between said container inner surface and said product;

d) a base plate having a central base plate opening and a plurality of retainer tabs, said base plate being planar and positioned perpendicular to said container inner surface, said retainer tabs being centrally located around a perimeter of said central base plate opening, said central base plate opening being sized to accommodate the insertion of said upper and lower threaded members, said lip, and said thickened region of said screw-feed advancing assembly, said retainer tabs capable of deflection such that said lip can pass upward through said tabs and be retained substantially in position.

2. The dispensing device of claim 1, wherein said container is open ended and tubular in shape, and said container cross section is rectangular shaped with rounded corners.

3. The dispensing device of claim 1, wherein said upper threaded member further includes a plurality of vertical segments.

4. The dispensing device of claim 3, wherein said upper threaded member is equally divided axially into said plurality of said vertical segments, and said vertical segments are capable of deflection, and having a closed vertical position, translating into an intermediate partially compressed position, and having a fully open compressed position, and said upper threaded member is constructed of a flexible material which enables axial compression of said vertical segments into said fully open compressed position, corresponding to said container being fully loaded with product, and said vertical segments are capable of regaining substantial vertical elevation in transition to said closed vertical position, as said product is removed from said container, and said vertical segments are available for helical engagement by said sleeve inner surface.

5. The dispensing device of claim 4, wherein said central rod retaining plate is capable of fitting within said lower threaded member, while being incapable of fitting within said upper threaded member, such that said plate acts as a lower retaining means for said central rod, and said central rod head is incapable of fitting within said upper threaded member, such that said head acts as an upper retaining means for said central rod.

6. The dispensing device of claim 5, wherein said short fins are each located perpendicular to and in between each said long fins.

7. The dispensing device of claim 2, wherein each of said short fins and each of said long fins are of equal length, and each of said fins is positioned to align with one of the four rounded corners of said rectangular container.

8. The dispensing device of claim 7, wherein said plunger is rectangular shaped with rounded corners.

9. The dispensing device of claim 7, wherein said gasket is rectangular shaped with rounded corners.

10. The dispensing device of claim 7, wherein said base plate is rectangular shaped with rounded corners.

11. The dispensing device of claim 5, wherein said base plate is capable of releasable attachment to an upper surface of said support flange in said container lower end.

12. The dispensing device of claim 5, wherein said base plate is formed as an integral part of said container.

13. The dispensing device of claim 3, wherein said central rod further includes a spacer ring and a rod top plate, said rod top plate being planar, circular in shape, and formed just below said central rod head, said spacer ring being planar and having a plurality of spacer tabs, said spacer ring being circular and made to fit loosely around said central rod elongated member, said spacer ring being set in a stationary position on top of said lower threaded member upper end, said spacer tabs being located along the periphery of said spacer ring, said spacer tabs being flexible and made to maintain a clearance distance between said vertical segments and said lower threaded member upper end.

14. The dispensing device of claim 13, wherein said upper threaded member vertical segments are each securedly attached at their upper end to said rod top plate by a segment hinge.

15. The dispensing device of claim 14, wherein said upper threaded member vertical segments are made of rigid material, and have a closed vertical position, translate into an intermediate partially open position, and have a fully opened position, said vertical segments being hinged into said fully opened position when said container is fully loaded with said product, said vertical segments being capable of regaining substantial vertical elevation in transition to said closed vertical position, as said product is removed from said container, whereby as said vertical segments reach said closed position, said upper threaded member lower end aligns and meets with said lower threaded member upper end.

* * * * *